US009735475B2

(12) United States Patent
Anderson et al.

(10) Patent No.: US 9,735,475 B2
(45) Date of Patent: Aug. 15, 2017

(54) LOW COST ANTENNA ARRAY AND METHODS OF MANUFACTURE

(71) Applicant: Anderson Contract Engineering, Inc., Apopka, FL (US)

(72) Inventors: Brian Anderson, Apopka, FL (US); Christopher Snyder, Melbourne, FL (US)

(73) Assignee: Anderson Contract Engineering, Inc., Apopka, FL (US)

( * ) Notice: Subject to any disclaimer, the term of this patent is extended or adjusted under 35 U.S.C. 154(b) by 38 days.

(21) Appl. No.: 14/557,249

(22) Filed: Dec. 1, 2014

(65) Prior Publication Data

US 2016/0156109 A1 Jun. 2, 2016

(51) Int. Cl.

| | |
|---|---|
| ***H01Q 21/12*** | (2006.01) |
| ***H01Q 21/00*** | (2006.01) |
| ***H01Q 21/06*** | (2006.01) |
| ***H01Q 21/24*** | (2006.01) |

(52) U.S. Cl.
CPC ..... *H01Q 21/0093* (2013.01); *H01Q 21/0006* (2013.01); *H01Q 21/062* (2013.01); *H01Q 21/24* (2013.01)

(58) Field of Classification Search
CPC ..... H01Q 21/00; H01Q 21/0006; H01Q 21/0093; H01Q 21/12
See application file for complete search history.

(56) References Cited

U.S. PATENT DOCUMENTS

| | | | | |
|---|---|---|---|---|
| 5,909,191 | A | 6/1999 | Hirshfield | |
| 6,268,828 | B1 * | 7/2001 | Martek | H01Q 3/242 342/373 |
| 6,351,246 | B1 * | 2/2002 | McCorkle | H01Q 1/38 343/786 |
| 6,429,816 | B1 | 8/2002 | Whybrew et al. | |
| 7,443,345 | B2 * | 10/2008 | Zhang | H01Q 1/246 343/700 MS |
| 2002/0122010 | A1 | 9/2002 | McCorkle | |
| 2003/0189516 | A1 | 10/2003 | Olson | |
| 2009/0295500 | A1 * | 12/2009 | Ives | H01P 5/16 333/128 |
| 2015/0126135 | A1 * | 5/2015 | Katipally | H04B 17/00 455/77 |

OTHER PUBLICATIONS

PCT/US15/63031, Search Report and Written Opinion, Feb. 26, 2016, 11 pages.

* cited by examiner

*Primary Examiner* — Hoang Nguyen
(74) *Attorney, Agent, or Firm* — Cesari & Reed LLP; R. Michael Reed

(57) ABSTRACT

In some embodiments, an apparatus may include a conductive planar structure having a plurality of antenna elements and a plurality of cutout portions. The plurality of cutout portions may define a combiner circuit including an output interface and including a combiner circuit coupled between each of the plurality of antenna elements and the output interface.

19 Claims, 11 Drawing Sheets

900

LOW COST ANTENNA ARRAY AND METHODS OF MANUFACTURE

FIELD

The present disclosure is generally related to antennas and antenna arrays, and more particularly to low cost antenna arrays and methods of manufacture.

BACKGROUND

Antennas are widely used in communication systems, radio systems, radar systems, and so on. Antennas may be used to receive radio frequency (RF) signals and to transmit RF signals.

SUMMARY

In some embodiments, an apparatus may include a conductive planar structure having a plurality of antenna elements and a plurality of cutout portions. The plurality of cutout portions may define a combiner circuit including an output interface and including a combiner circuit coupled between each of the plurality of antenna elements and the output interface.

In other embodiments, a method may include providing a monolithic, conductive antenna structure having multiple antenna elements, an output interface, and an integrated combiner circuit coupling the multiple antenna elements to the output interface. The method may further include coupling a spacer to the monolithic, conductive antenna structure to form an antenna column.

In still other embodiments, an apparatus may include an antenna structure formed from sheet of conductive material in a plane. The antenna structure may include an output interface, a plurality of antenna elements, and a combiner circuit formed from a plurality of cutout portions defining strip-line conductors extending between the plurality of antenna elements and the output interface.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

Embodiments of apparatuses, antenna structures, and methods of manufacture are described below, which may be used to produce devices that may include one or more antennae configured to receive radio frequency signals.

Figure 1A:
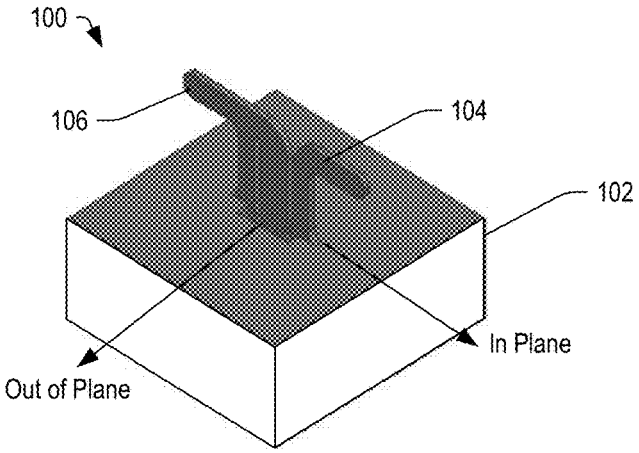
FIGS. 1A-1B are perspective views of a baseline element including a single polarization dipole element, in accordance with certain embodiments.
Figure 1B:
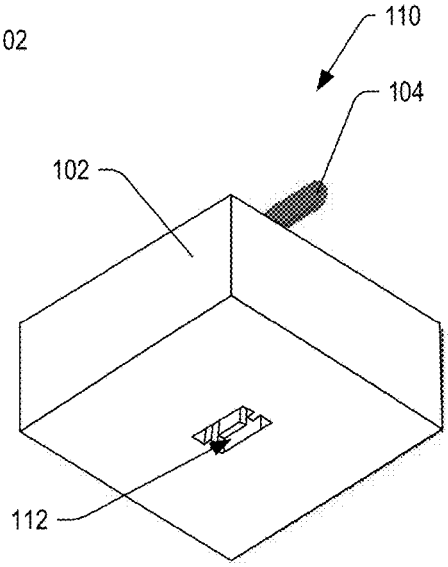

FIGS. 1A-1B are perspective views of a circuit including a single polarization dipole antenna element, in accordance with certain embodiments. In FIG. 1A, a single polarization unit cell model or baseline element 100 is shown that may include a ground plane 102 surrounding a single polarization dipole element including a first element 104 and a second element 106 arranged in a common plane. The first element 104 and the second element 106 extend vertically from a planar surface and curve in opposite directions in a common plane, i.e., aligned in plane. A direction orthogonal to the first and second elements 104 and 106 may be described as being out of plane.

The baseline element 100 may include a single linear polarization with a broad bandwidth of approximately two gigahertz (GHz). The baseline element 100 may include an integrated impedance matching balun to provide a transition between the balanced antenna element and the unbalanced corporate feed network. The integrated balun provides impedance matching and tunes the element for bandwidth in a highly coupled array environment.

In FIG. 1B, a perspective view of a bottom portion 110 of the baseline element 100 is depicted, which may include a quasi coplanar RF connector 112, which may couple to a coaxial or other type of connection to communicate received RF signals to an associated circuit. The ground plane 102 in the out-of-plane geometry may be formed from metal or plated plastic.

Figure 1C:
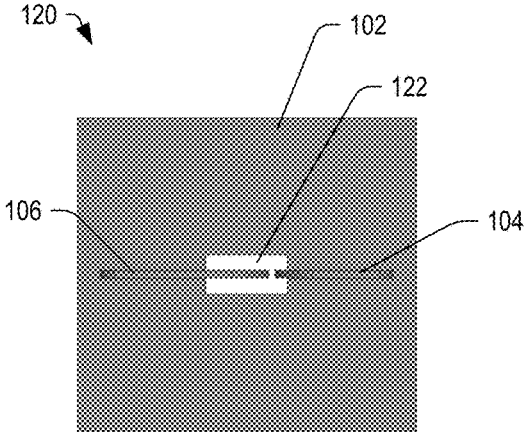
FIG. 1C is a top view of the baseline element of FIGS. 1A and 1B, in accordance with certain embodiments.

FIG. 1C is a top view 120 of the baseline element 100 of FIGS. 1A and 1B, in accordance with certain embodiments. The top view 120 may include the ground plane 102 and elements 104 and 106 and connection circuitry 122.

Figure 1D:
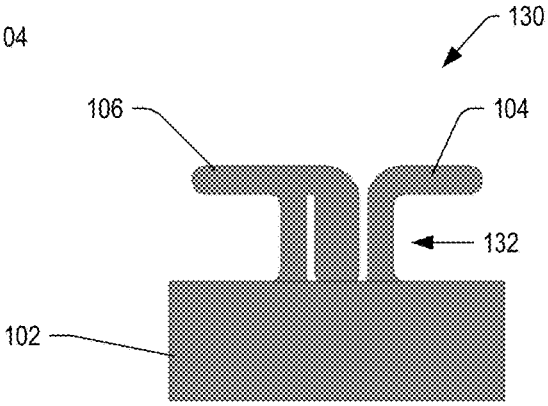
FIG. 1D is a side view of the baseline element of FIGS. 1A, 1B, and 1C, in accordance with certain embodiments.

FIG. 1D is a side view 130 of the dipole antenna of the baseline element 100 of FIGS. 1A, 1B, and 1C, in accordance with certain embodiments. The side view may include the elements 104 and 106 and integrated balun features 132. The dipole antenna 130 may be a 2D etched metal substrate having in-plane geometry (formed, for example, using photolithography fabrication), which may be sandwiched in metal or plated plastic (out-of plane geometry) to form the baseline element 100. The geometry of the baseline element 100 can be scaled in size to cover any frequency range. The baseline element 100 can be directly scalable (no dielectric) with inherently low loss and high efficiency. It should be appreciated that, because there is no dielectric substrate, the baseline element 100 can be scaled. The frequency dependence of the baseline element 100 may be based purely on geometry. Additionally, in some embodiments, the dielectric material may be lossy and may degrade efficiency. Accordingly, the baseline element 100 may be relatively low loss and higher efficiency because there is no dielectric.

Figure 2A:
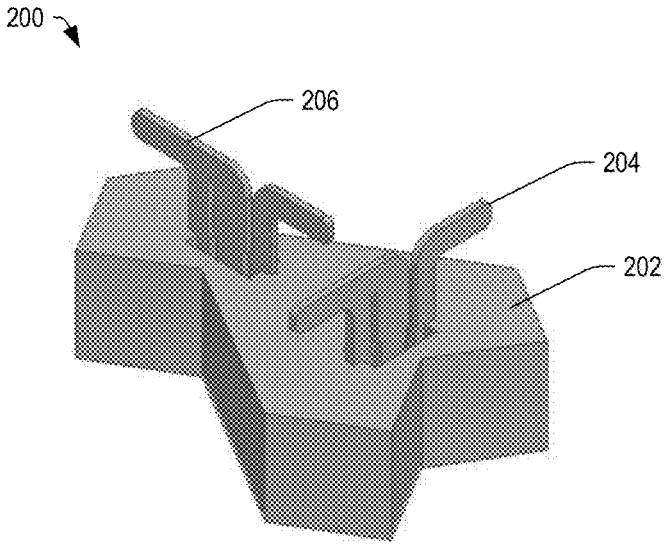
FIG. 2A is a perspective view of a portion of a circuit including a dual polarization dipole configuration, in accordance with certain embodiments.

FIG. 2A is a perspective view of a portion 200 of a circuit including a dual polarization dipole configuration, in accordance with certain embodiments. The portion may include a ground plane 202, a first dipole element 204, and a second dipole element 206. The first and second dipole elements 204 may be orthogonal, linear dipole elements in unit cell configurations. The first dipole element 204 may extend from the substrate 202 in a first plane, and the second dipole element 206 may extend from the substrate 202 in a second plane, which may be orthogonal to the first plane.

Figure 2B:
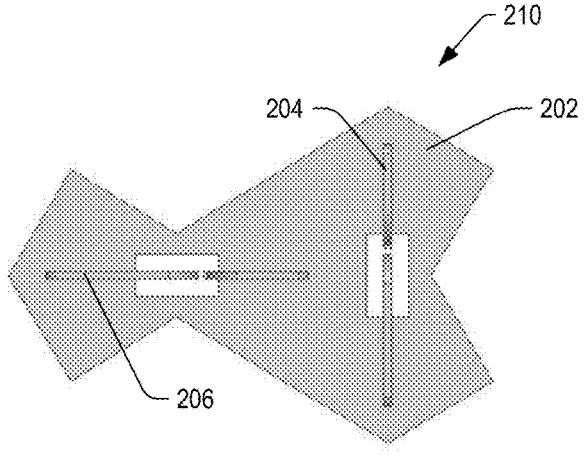
FIG. 2B is a top view of the circuit of FIG. 2A including a dual element cell, in accordance with certain embodiments.

FIG. 2B is a top view of the portion 200 of the circuit of FIG. 2A including a dual element cell 210, in accordance with certain embodiments. The dual element cell 210 may include the first dipole element 204 extending in a first plane and the second dipole element 206 extending in a second plane. The first plane and the second plane may be at an angle to one another, such as perpendicular (orthogonal) or at another angle.

The two orthogonal linear dipole elements 204 and 206 can provide dual linear polarization or can be combined to produce any two other orthogonal polarizations. In one particular example, the two orthogonal linear dipole elements 204 and 206 can provide dual linear polarizations for right and left circular polarization, which may be useful in satellite communications.

Figure 2C:
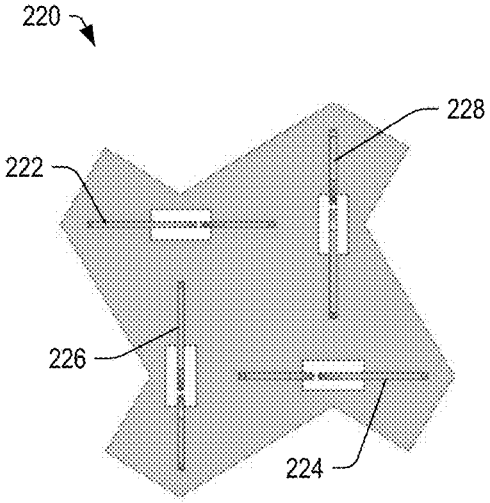
FIG. 2C is a top view of the circuit of FIG. 2A including a quad element cell with clocking, in accordance with certain embodiments.

FIG. 2C is a top view of the portion 200 of the circuit of FIG. 2A including a quad element cell 220 with clocking, in accordance with certain embodiments. The quad element cell 220 may include a first dipole antenna 222 and a second dipole antenna 224 extending in parallel planes. The quad element cell 220 may further include a third dipole antenna 226 and a fourth dipole antenna 228 extending in parallel planes that are at an angle relative to the parallel planes of the first and second dipole elements 222 and 224. In some embodiments, the parallel planes of the first and second dipole antennas 222 and 224 may be perpendicular (orthogonal) to the parallel planes of the third and fourth antennas 226 and 228. The unit cells may be combined to provide a quad cell 220 for improved cross-polarization isolation.

Figure 3A:
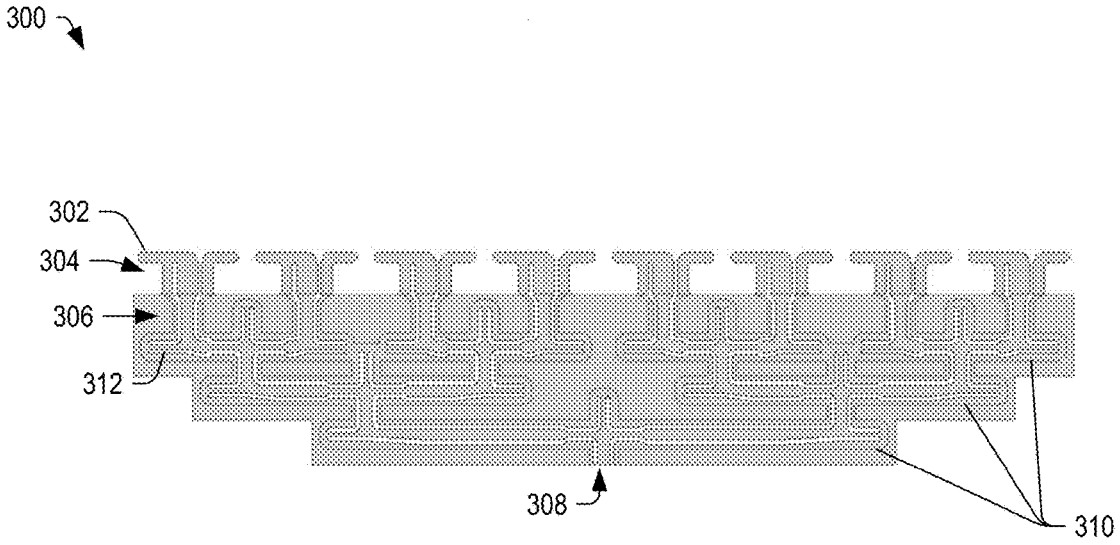
FIG. 3A is a side view of a linear array (column or stick) of multiple dipole antenna elements combined with a corporate, reactive feed network, in accordance with certain embodiments.

FIG. 3A is a side view of a linear antenna array 300 of multiple dipole elements, in accordance with certain embodiments. The linear antenna array 300 may include an array of elements 302 arranged in a common plane. The linear antenna array 300 is depicted as a 1×8 linear polarization array example; however, additional elements may be added in plane to extend the linear antenna array 300, such as to create a 1×16 linear polarization array or other configuration. Each element of the array of elements 302 can include an integrated balun 304, which may be configured to couple the element 302 to a reactive combiner circuit 306. The reactive combiner circuit 306 may include a waveguide probe interface 308 and a plurality of support stubs 310. Air gaps 312 may be carved, etched, or otherwise formed in the monolithic structure of the linear antenna array 300. The air gaps 312 define the dielectric around the strip-line conductor. Further, the width of the conductive portion may be varied along its length and at various points (such as where conductors from adjacent antenna elements 302 are combined) to provide selected resistances for impedance matching, mismatch cancellation, and so on.

In some embodiments, the elements 302 and the reactive combiner circuit 306 may be manufactured together as the same monolithic physical component using an etching process, a machining process, a laser cutting process, a stamping process, other processes, or any combination thereof. In some embodiments, the elements 302, the baluns 304, and the reactive combiner circuit 306 may be manufactured using an etched process. In some embodiments, the support stubs 310 may be formed by ¼λ shorted stubs that may provide impedance mismatch cancellation as well as mechanical support.

In some embodiments, out-of-plane combining of the linear antenna array 300 with other similar arrays may be achieved by sandwiching the linear antenna array 300 between two spacers and by coupling the resulting structure to other similar structures. These linear antenna arrays 300 are sometimes referred to as "columns" or "sticks", and they can be stacked to produce larger arrays using the in-plane combiners 306. An out-of-plane structure may be provided to separate the linear antenna array 300 from adjacent arrays and to support the array. The out-of-plane structure may have a width selected to space the rows of antenna elements 302 in an out-of-plane direction by the same amount of space as that which separates the antenna elements 302 in an in-plane direction. One possible example of such an out-of-plane structure is described below with respect to FIG. 3B.

Figure 3B:
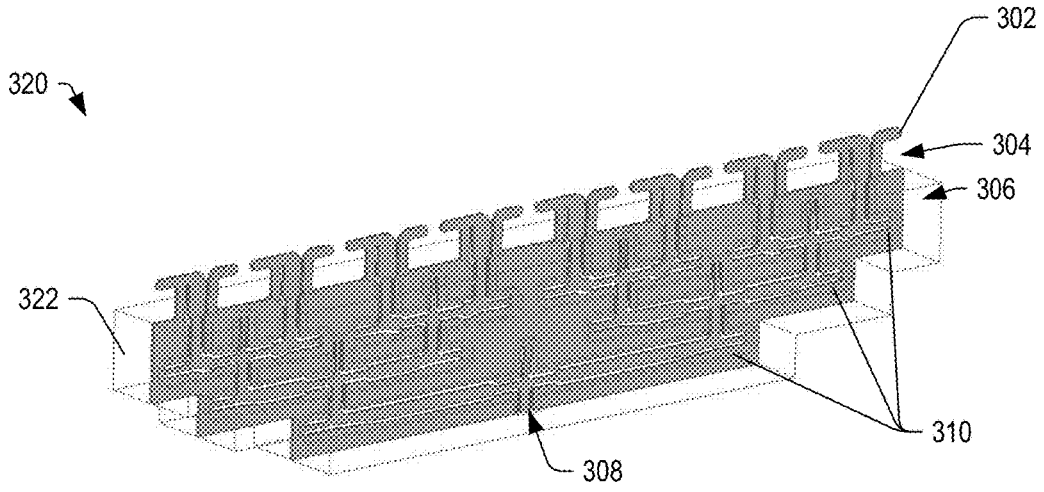
FIG. 3B is a perspective view of structure including a linear array of multiple dipole antenna elements combined with a corporate, reactive feed network, and including an out-of-plane structure, in accordance with certain embodiments.

FIG. 3B is a perspective view of structure 320 including a linear antenna array 300 and including an out-of-plane structure 322, in accordance with certain embodiments. The out-of-plane structure 322 may secure the linear antenna array 302 to a mounting structure, to other linear antenna arrays, to circuitry, or any combination thereof. In some embodiments, the out-of-plane structure may be formed of metal or plated plastic parts.

While the embodiments described with respect to FIGS. 3A and 3B depict a single linear array, it should be appreciated that a selected number of arrays may be coupled to form a larger array of a selected dimension. Examples of larger antenna arrays are described below with respect to FIGS. 4A and 4B.

Figure 4A:
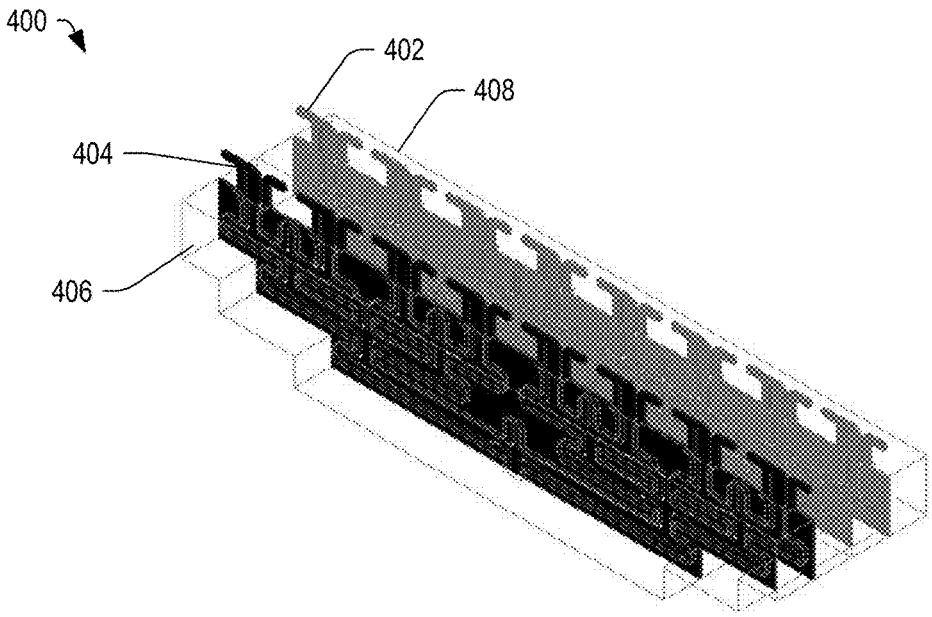
FIG. 4A is a perspective view of a structure including linear antenna arrays stacked via out-of-plane structures to form a 2×8 array of dipole elements, in accordance with certain embodiments.

FIG. 4A is a perspective view of a structure 400 including linear antenna arrays 402 and 404 stacked via out-of-plane structures 406 and 408 to form a 2×8 array of dipole elements, in accordance with certain embodiments. The linear antenna arrays 402 and 404 may be monolithic etched parts (in plane) including antenna elements, baluns, reactive combiner circuits, and waveguide feeds. The monolithic etched parts may be coupled to and spaced part from adjacent arrays by the out-of-plane structures 406 and 408. Additional rows of antenna arrays may be added to expand the array to a selected size.

Figure 4B:
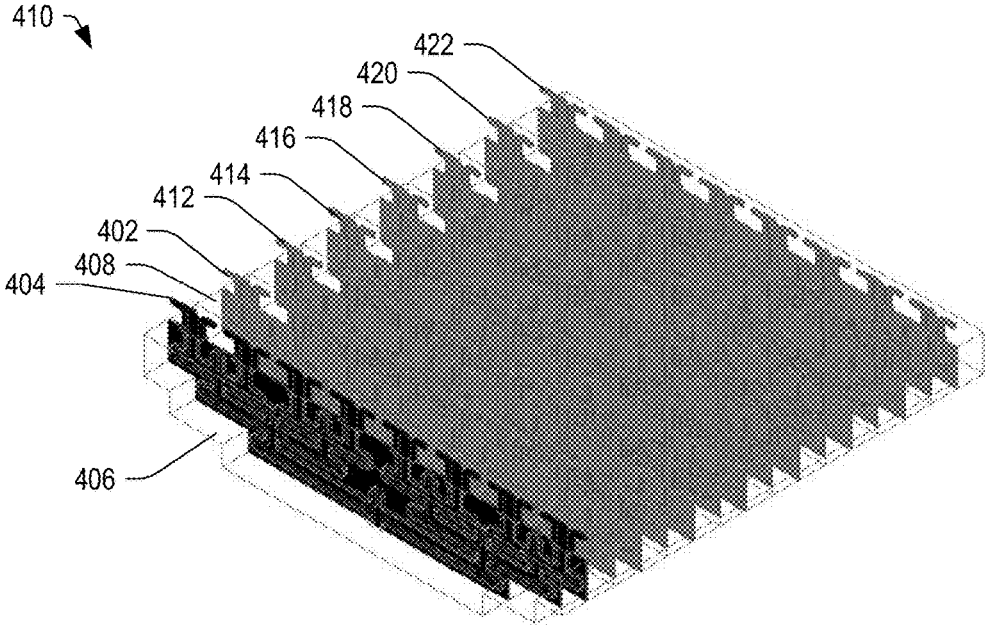
FIG. 4B is a perspective view of a structure including linear antenna arrays stacked via out-of-plane structures to form an 8×8 array of dipole elements, in accordance with certain embodiments.

FIG. 4B is a perspective view of a structure 410 including linear antenna arrays 402, 404, 412, 414, 416, 418, 420, and 422 stacked via out-of-plane structures, such as out-of-plane structures 406 and 408 to form a 8×8 array of dipole elements, in accordance with certain embodiments. In certain embodiments, a number (N) of antenna arrays may be stacked and the signal combinations can be performed in the out of plane dimension with associated circuitry.

In some embodiments, commonality of the out-of-plane structures 406 and 408 and the linear antenna arrays 402, 404, 412, 414, 416, 418, 420, and 422 allow for one-dimensional scaling via slices that may be added. Further, the modular adaptable architecture allows for arrays of any width (modular elements stacked to form arrays of any width for different operational geometries, such as small aircraft, large aircraft, etc.).

Figure 5A:
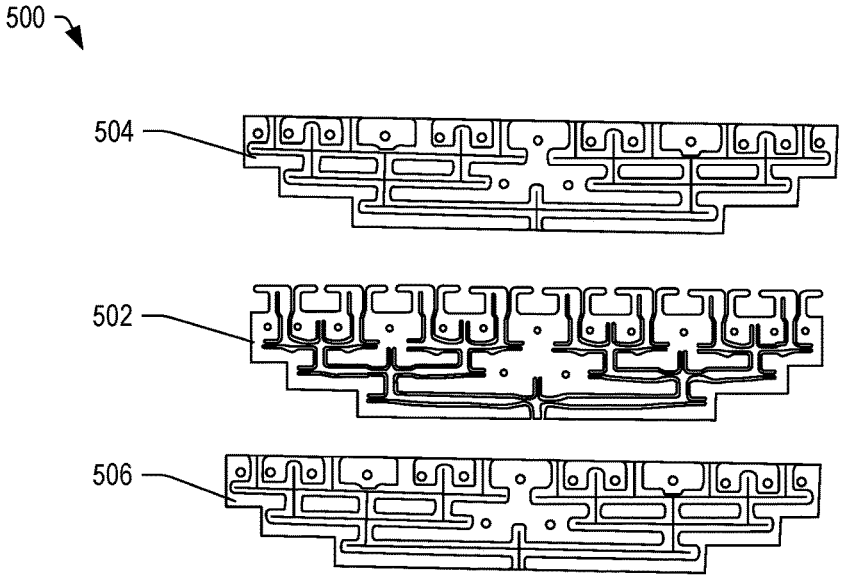
FIG. 5A is a side view of a portion of an antenna array including the linear antenna structure and spacers to provide an out-of-plane dimension, sometimes referred to as a "column" or "stick", in accordance with certain embodiments.

FIG. 5A is a side view of a portion 500 of an antenna array including the linear antenna structure 502 and spacers 504 and 506 to provide an out-of-plane dimension, in accordance with certain embodiments. The spacers 504 and 506 may sandwich the antenna structure 502 and may couple to adjacent spacers 504 and 506 or to an adjacent antenna structure to expand the antenna array.

In some embodiments, the antenna structure 502 may be formed using photolithographic techniques. In some embodiments, the antenna structure 502 may be a single polarization antenna formed from multiple dipole elements in a common plane (formed with flat parts). In some embodiments, multiple electrical functions may be integrated into the antenna structure 502, including radiating dipole elements, impedance matching baluns, an N-way in-plane reactive combiner including shorting stubs to provide impedance mismatch cancellation and mechanical support, and probes for out-of-plane combination with adjacent antenna structures or with associated circuitry.

The out-of-plane dimensions may be formed by the spacers 504 and 506. In some embodiments, the spacers 504 and 506 may be formed from machined metal, plated injection molded plastic, stereolithography (SLA), or direct metal laser sintered (DMLS) parts, allowing for manufacturing flexibility for both cost and throughput. Further, the spacers 504 and 506 may be configured to provide any desired inter-element array spacing. By utilizing the spacers 504 and 506 to define spacing between adjacent antenna structures 502, the "stacking" of the modular elements provides for an arbitrary array size in a width dimension.

The spacers 504 and 506 may form a ground plane for the antenna structure 502. Further, the spacers 504 and 506 may include etched portions that may correspond to the conductive strip-line elements such that the air gaps (such as air gaps 312 in FIG. 3A) cooperate with the etched portions to electrically isolate the strip-line elements from the spacers 504 and 506, except at locations corresponding to the shorting stubs.

Figure 5B:
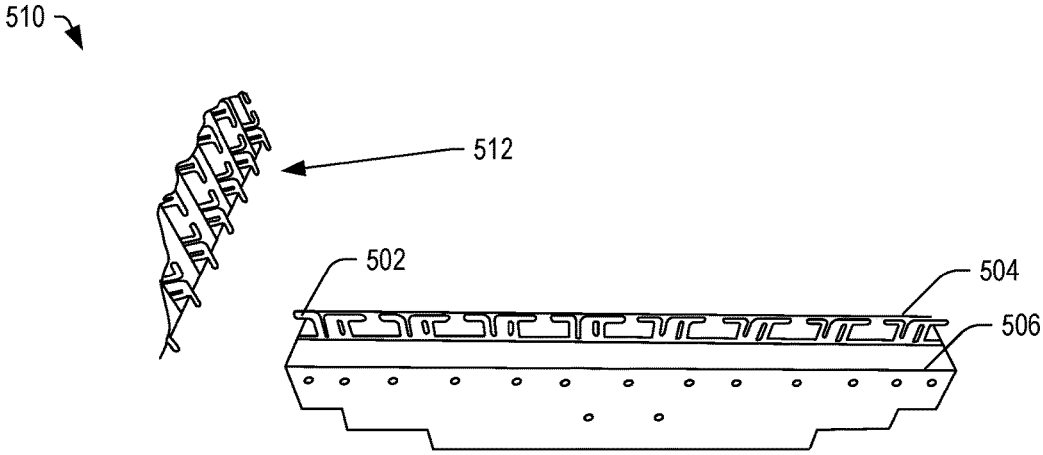
FIG. 5B is a perspective view of the portion of the antenna array of FIG. 6A in an assembled state, in accordance with certain embodiments.
Figure 6A:
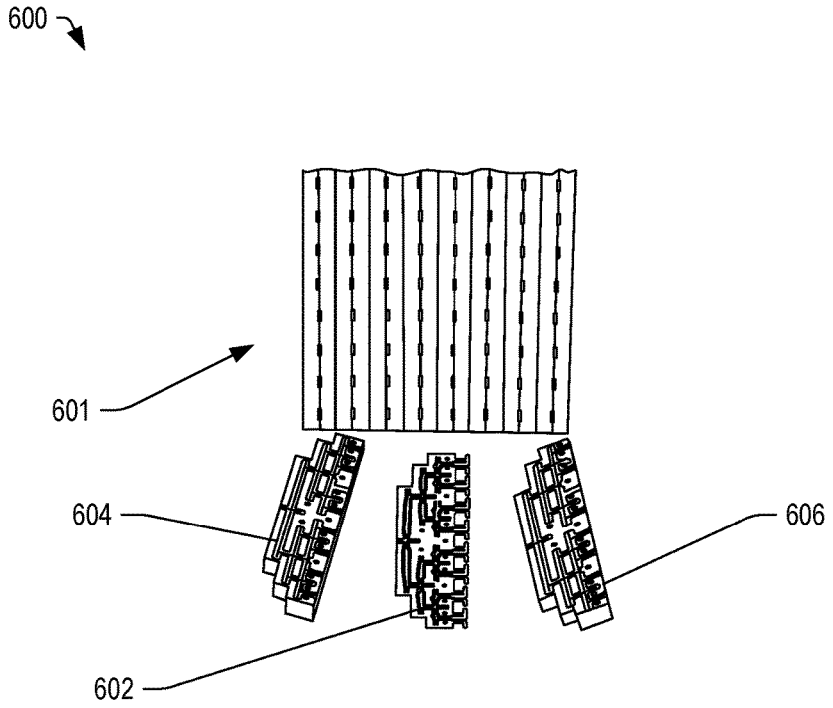
FIG. 6A is a view of an assembled antenna array and a separate antenna structure including associated spacers, in accordance with certain embodiments.

FIG. 5B is a perspective view 510 including a portion of an antenna array 512 formed from the component parts depicted in of FIG. 6A in an assembled state, in accordance with certain embodiments. In the illustrated example, the antenna structure 502 can be sandwiched between spacers 504 and 506 to form a modular antenna column or stick that may be added to the antenna array 512 to extend the array by one row of dipole elements. Additional antenna structures 502 and spacers 504 and 506 may be included to further extend the antenna array to a selected size.

FIG. 6A is a view 600 of an assembled antenna array 601 and a separate antenna structure 602 with associated spacers 604 and 606, in accordance with certain embodiments. As discussed above, the antenna structure 602 may form a single polarization antenna of multiple dipole elements, baluns, a reactive combiner circuit, and a waveguide connection interface. In some embodiments, the antenna structure 602 may be formed from flat parts formed in a common plane from a monolithic element.

In some embodiments, the antenna structure 602 may be sandwiched between the spacers 604 and 606 to form an antenna module, which may be coupled to another antenna module to extend an antenna array. In some embodiments, the antenna structure 602 may include eight dipole elements (as shown), or may include another number of dipole elements. Further, while the assembled antenna array 601 may be an eight-by-eight array of dipole elements, additional antenna modules may be added to extend the size of the array to form an N×8 array, in this example. In other examples, the antenna structure 602 may include a number (M) of dipole elements extending in a linear arrangement, and the antenna structure 602 may be coupled to a number (N) of other similar antenna structures 602 to form an M×N antenna array. In other examples, the antenna structure 602 may include a first number of dipole elements, and a second antenna structure may include a second number of dipole elements. These antenna structures may be coupled to form an array of a selected size and polarization.

Figure 6B:
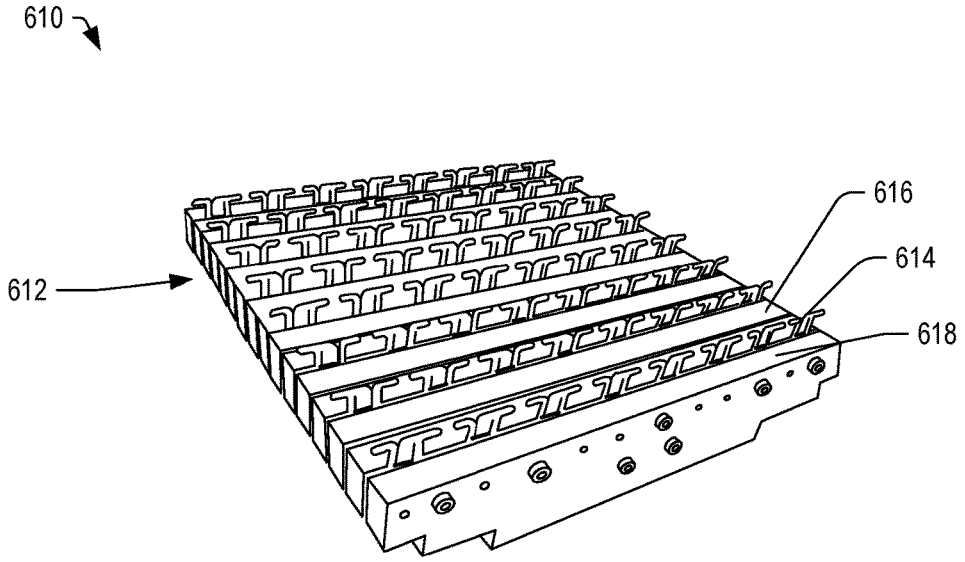
FIG. 6B is a perspective view of an assembled antenna array, in accordance with certain embodiments.

FIG. 6B is a perspective view 610 of an assembled antenna array 612, in accordance with certain embodiments. The antenna array 612 may include a plurality of antenna structures, such as the antenna structure 614, sandwiched between spacers 616 and 618. The spacers 618 and 616 may be coupled to one another and to the antenna structure 614 using fasteners, such as screws, bolts, or other fasteners, which may be accessible to maintenance personnel to replace antenna modules or to add or remove antenna modules in order to selectively adjust the size of the antenna array.

While the examples described above with respect to FIGS. 3A, 3B, 4A, 4B, 5A, 5B, 6A, and 6B included dipole elements extending in common planes or in parallel planes and, it is also possible to assemble a modular array having dipole arrays formed of elements arranged at angles relative to one another. Some possible examples are described below with respect to FIGS. 7A and 7B.

Figure 7A:
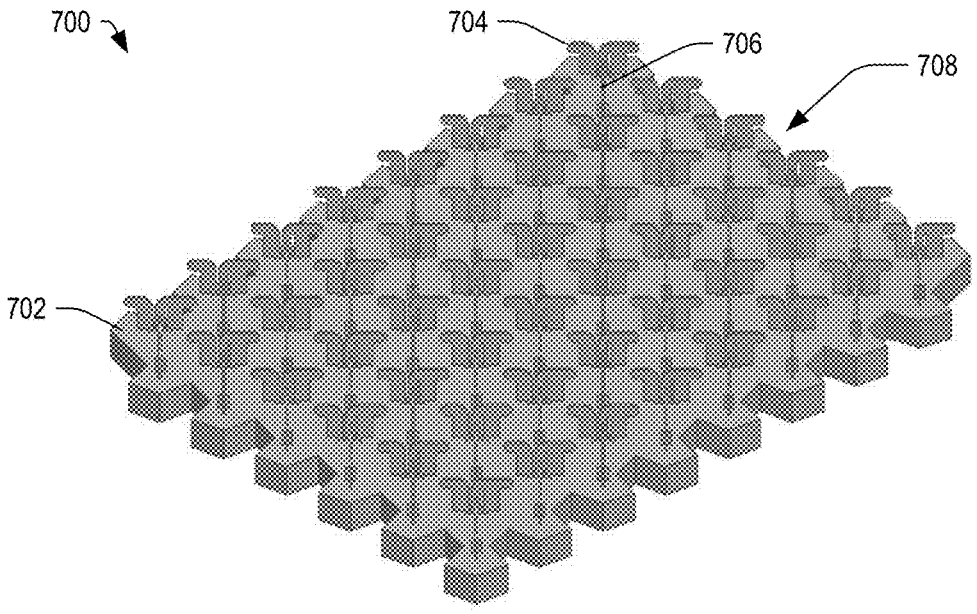
FIG. 7A is a perspective view of a structure including an antenna array of multiple in-plane dipole elements bent to provide slant polarization, in accordance with certain embodiments.

FIG. 7A is a perspective view of a structure 700 including an antenna array 708 of multiple in-plane dipole elements bent to provide slant polarization, in accordance with certain embodiments. The antenna array 708 may be formed from antenna modules, such as those described above with respect to FIGS. 5A, 5B, 6A, and 6B, where the dipole elements, such as elements 704 and 706, are bent into orthogonal planes to provide dual polarization.

In some embodiments, the modular concept as described herein may be applied to produce the dual polarization array 708. In an example, the antenna module may be formed with each of the dipole elements bent in the same orientation to form parallel plane dipole elements. Elements slanted in a first direction form one polarization, and elements slanted 90 degrees from that first direction form the orthogonal polarization. A second antenna module may be formed that has the elements slanted 90 degrees from the first direction and may be arranged next to a first column so that the adjacent rows of dipole elements within the array can form the orthogonal polarization. In some embodiments, the columns or sticks of similarly slanted elements can be arranged 180 degrees apart to improve cross-polarization. In some embodiments, columns of like polarization may be coupled together via feed structures. In some embodiments, the dipole elements within a module may be bent at an angle of approximately 45 degrees, such that adjacent rows have dipole elements that extend in orthogonal planes, thereby providing alternate left and right slant polarization parts.

In some embodiments, by utilizing common parts (monolithic element, spacers, etc.), production costs can be reduced. Moreover, since the same part may be used for both polarizations, the cost in production and inventory is reduced. Additionally, the modular concept allows for production of arrays of selected sizes.

Figure 7B:
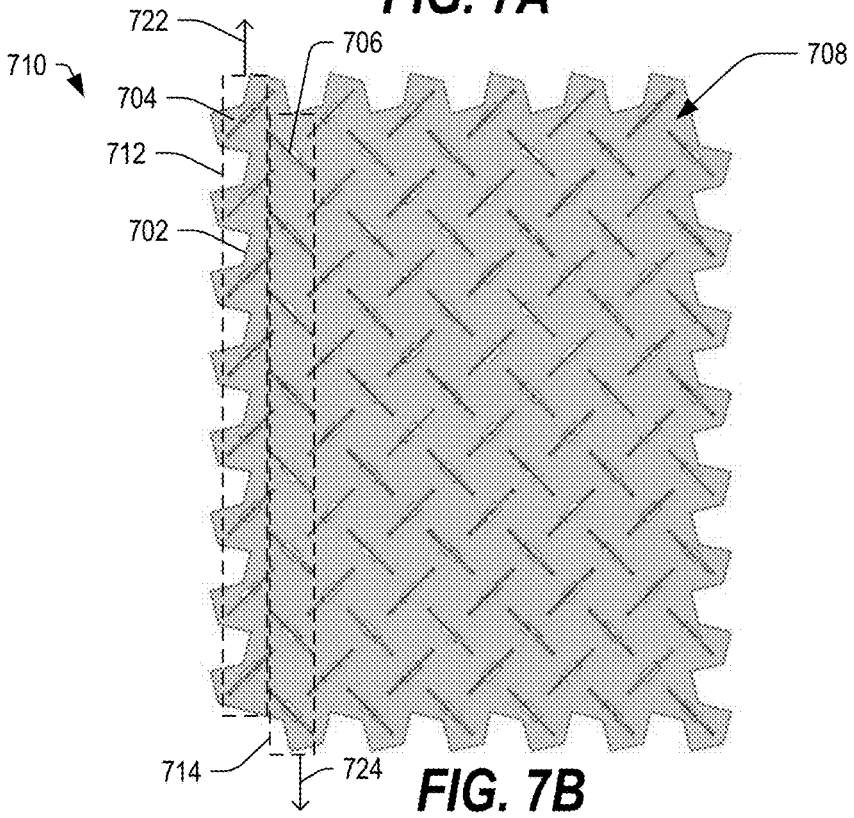
FIG. 7B is a top view of the structure of FIG. 7A, in accordance with certain embodiments.

FIG. 7B is a top view 710 of the structure 700 of FIG. 7A, in accordance with certain embodiments. The top view 710 depicts a dashed box 712 that encloses a first antenna module having multiple dipole elements slanted toward the left (in the drawing) and a dashed box 714 that encloses a second antenna module having multiple dipole elements slanted toward the right (in the drawing). As mentioned above, the second antenna module indicated by the dashed box 714 may be identical to the antenna module of the dashed box 712, except that the antenna elements may be bent at an angle of 90 degrees relative to those within the dashed box 712, causing the dipole elements to be oriented orthogonal to one another, providing dual polarization. The in-plane slices can be bent to provide slant polarization, slanting left or right, and the in-plane combiner circuits may be used to combine the received signals. In some embodiments, the array may be coupled to one or more out-of-plane combiners via a probe-fed waveguide or associated circuitry.

In some embodiments, the antenna array 708 may be arranged in a dual or single polarization and may be sized by adding antenna modules. In some embodiments, the antenna array may be sized arbitrarily in one dimension, while the other dimension may be fixed by the number of dipole elements in the particular antenna structure.

Figure 8:
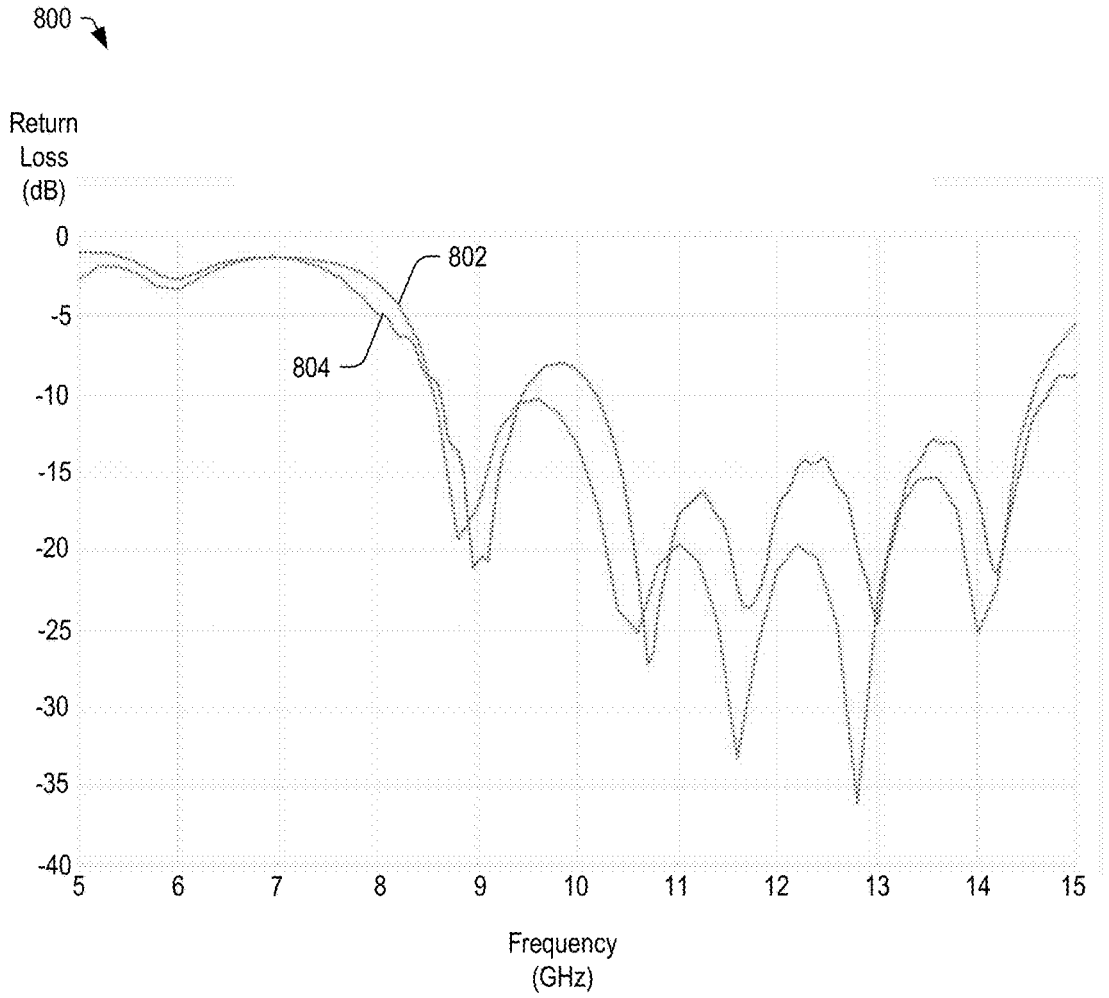
FIG. 8 is a graph of return loss in decibels (dB) versus frequency (in Gigahertz (GHz) for a 1×8 linear cell, in accordance with certain embodiments.

FIG. 8 is a graph 800 of return loss in decibels (dB) versus frequency (in Gigahertz (GHz) for a 1×8 linear cell, in accordance with certain embodiments. The graph 800 includes a first line 802 corresponding to the return loss versus frequency for a simulated 1×8 linear cell and a second line 804 corresponding to measurement of the return loss versus frequency for a 1×8 linear cell.

In some embodiments, at frequencies between 8 and 14 GHz, the return loss varies over a range of about −5 dB to about −36 dB. However, such frequencies correspond to X-band (military frequencies in ranges from 8-12 GHz) and Ku-band (12-18 GHz) for satellite communications and direct broadcast satellite services. Thus, the antenna module can be used to receive RF signals in the satellite communications frequency band. It should be appreciated that the circuit is broadband as compared to more narrowband devices, and can be used in a variety of bands for satellite communications.

Figure 9:
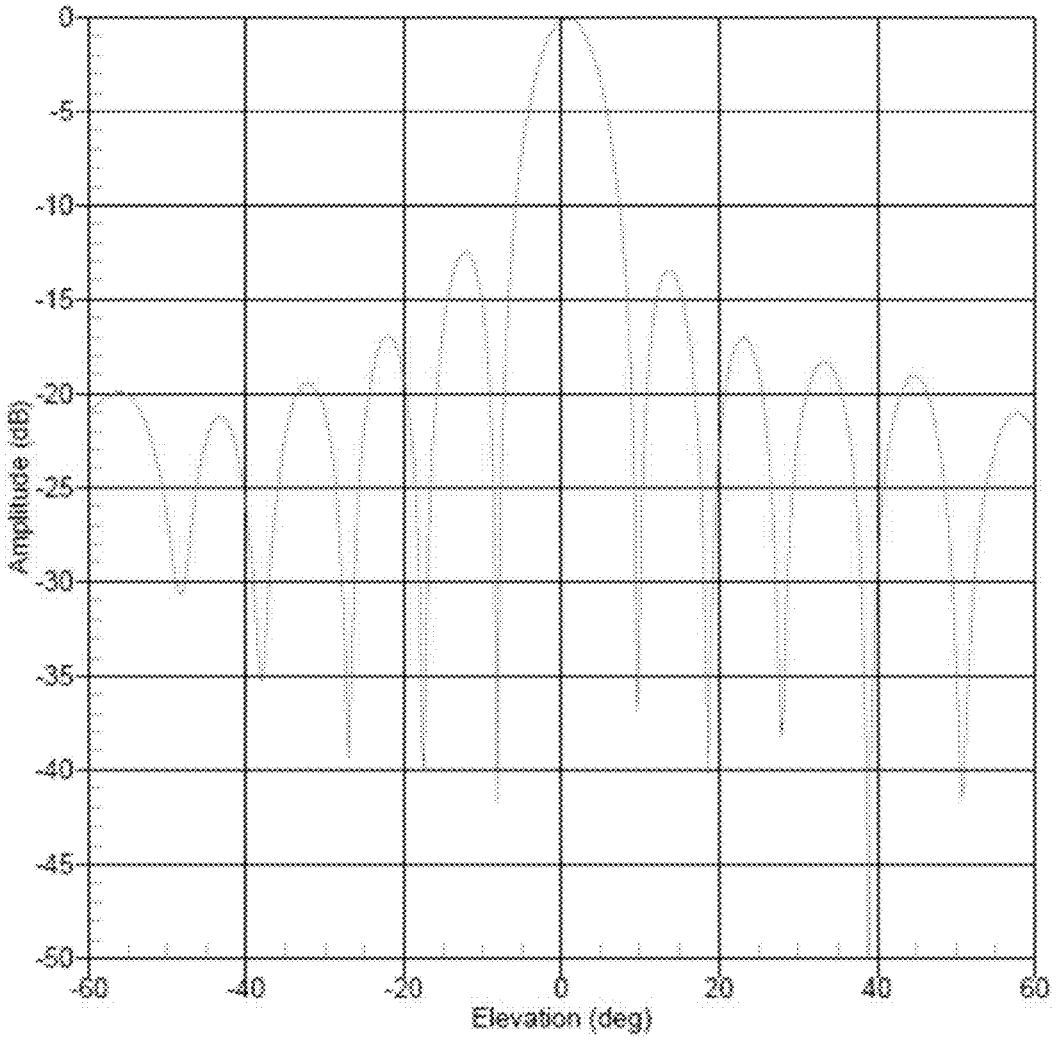
FIG. 9 is a graph of far field amplitude (dB) versus elevation (degrees) for an 8×8 antenna array, in accordance with certain embodiments.

FIG. 9 is a graph 900 of far field amplitude (dB) versus elevation (degrees) for an 8×8 antenna array, in accordance with certain embodiments. As shown, at the Main Lobe region and the Side Lobe region, the far field signal amplitude in dB varies from about −13 dB to about −42 dB. The pattern in graph 900 was normalized to zero at the peak.

Figure 10:
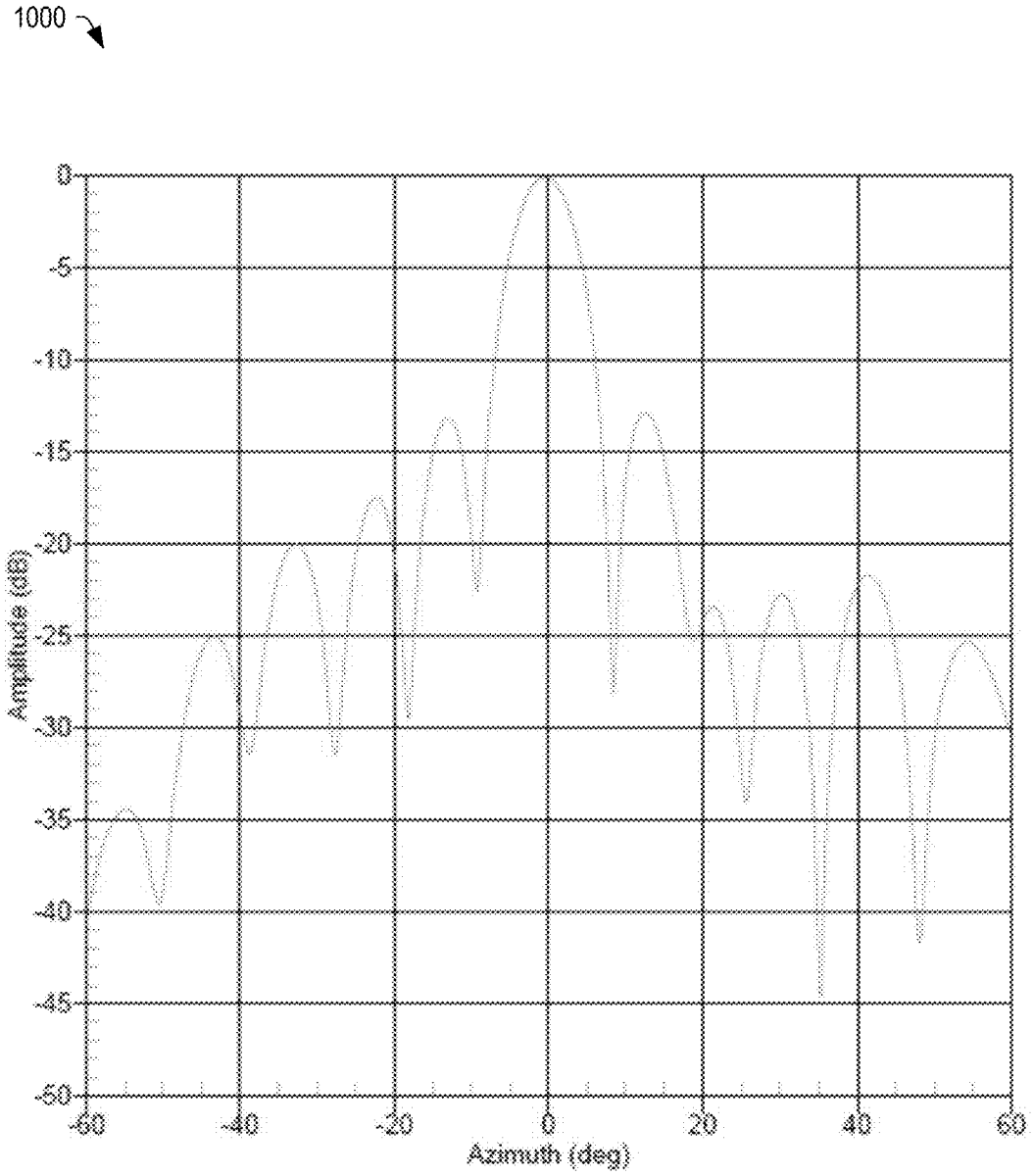
FIG. 10 is a graph of far field amplitude (dB) versus azimuth (degrees) for an 8×8 antenna array, in accordance with certain embodiments.

FIG. 10 is a graph 1000 of far field amplitude (dB) versus azimuth (degrees) for an 8×8 antenna array, in accordance with certain embodiments. At an azimuth of approximately zero degrees, the far field signal amplitude in dB is approximately zero. As the azimuth varies between about plus or minus 5 degrees to plus or minus 60 degrees, the far field signal amplitude in dB varies from about −13 dB to about −44 dB.

With respect to FIG. 8, the directivity displayed by the elevation and azimuth graphs 900 and 1000, respectively, gain measurements indicate greater than 80 percent efficiency.

Figure 11:
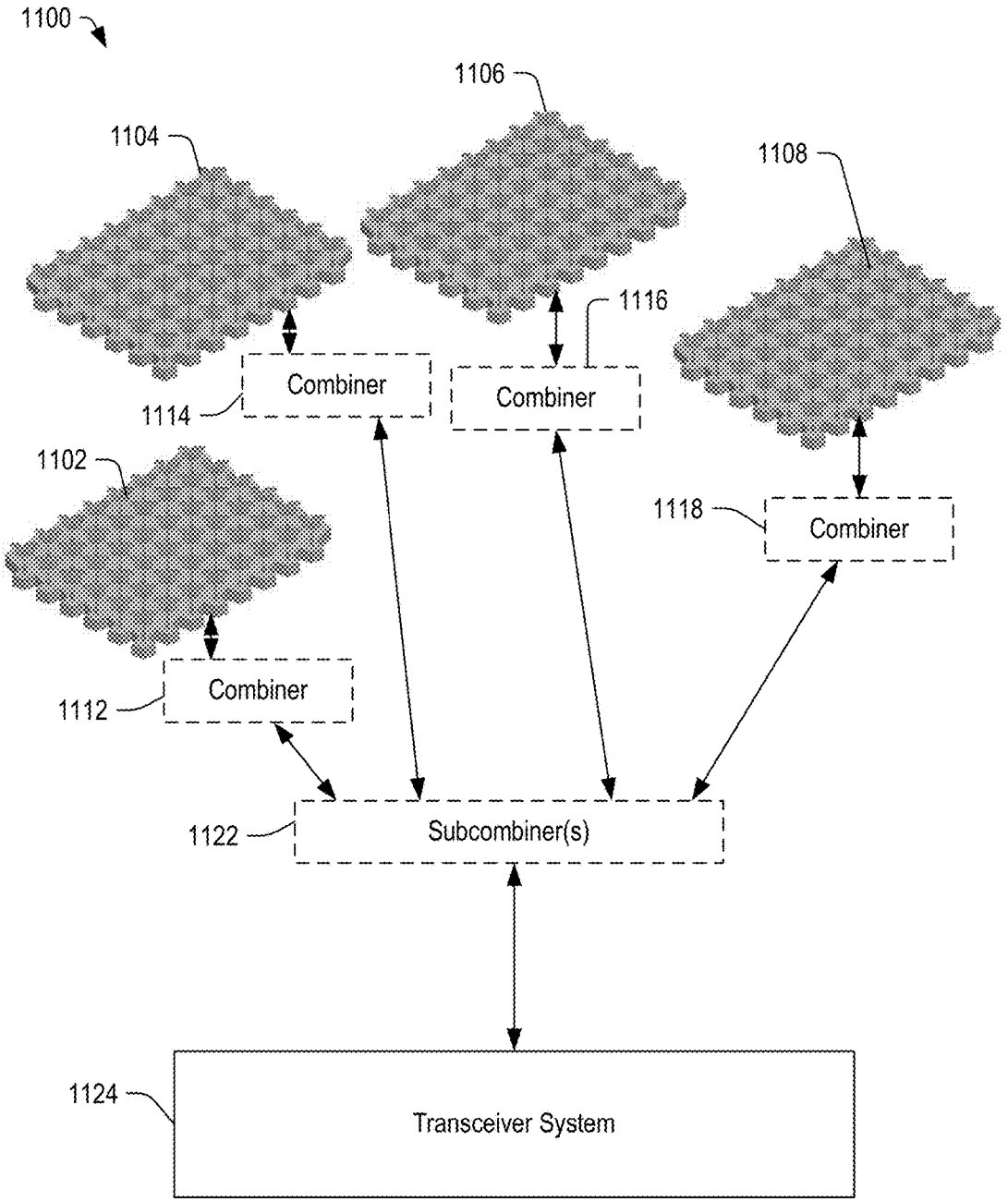
FIG. 11 is a block diagram of a system including multiple subarrays of antennas coupled to a transceiver system, in accordance with certain embodiments.

FIG. 11 is a block diagram of a system 1100 that can include multiple antenna arrays 1102, 1104, 1106, and 1108 coupled to a transceiver system 1124, in accordance with certain embodiments. Each of the multiple antenna arrays 1102, 1104, 1106, and 1108 may be formed from multiple antenna columns or sticks, each of which includes an integrated combiner circuit. The signals from the output of each of the columns or sticks of each of the multiple antenna arrays 1102, 1104, 1106, and 1108 may be provided to combiner circuit 1112, 1114, 1116, and 1118, respectively. The combiner circuits 1112, 1114, 1116, and 1118 may be coupled to one or more subcombiner circuits 1122, which may be coupled to a transceiver 1124.

In some embodiments, the transceiver system 1124 may be coupled to one or more antenna arrays. Further, though the transceiver system 1124 is depicted as being coupled to four antenna arrays, the transceiver system 1124 may be coupled to one or more antenna arrays. Further, though the antenna arrays 1102, 1104, 1106, and 1108 are depicted as being the same size, it should be appreciated that the transceiver system 1112 may be coupled to antenna arrays of different dimensions. Additionally, though the antenna arrays 1102, 1104, 1106, 1108, and 1110 are depicted as being dual polarization arrays, in some embodiments, one or more of the antenna arrays 1102, 1104, 1106, and 1108 may be implemented as single polarization arrays. In some embodiments, four or more arrays may be combined in the out-of-plane direction to form one large array.

In some embodiments, the transceiver system 1124 may include signal processing circuitry configured to demodulate one or more channels from received RF signals and to provide the demodulated channel data to an output, such as a display or network within a cabin of an airplane. Further, the transceiver system 1124 may be coupled to a control system configured to charge consumers for access to demodulated data and to selectively provide data to one or more user devices.

It should be appreciated that the antenna arrays may be formed by coupling a selected number of antenna columns or sticks, and multiple antenna arrays may be coupled together to form an antenna array of selected dimensions. Further, it should be appreciated that, since the antenna uses an air dielectric, the monolithic antenna structure may be scaled in geometry without having to perform dielectric In conjunction with the antenna modules and the associated circuitry, a modular antenna configuration is described, which may be used to provide single or dual polarization antenna arrays. In some embodiments, a linear antenna structure may be coupled to other linear antenna structures to produce an antenna array of a selected dimension.

Although the present invention has been described with reference to preferred embodiments, workers skilled in the art will recognize that changes may be made in form and detail without departing from the scope of the invention.

What is claimed is:

1. An apparatus comprising:

a conductive planar structure including:

a plurality of antenna elements;

a plurality of cutout portions defining a circuit including an output interface and including a combiner circuit coupled between each of the plurality of antenna elements and the output interface; and at least one spacer configured to couple to the conductive planar structure to form an antenna column, the at least one spacer configured to provide a ground plane and including a plurality of etched portions corresponding to the cutout portions of the conductive planar structure.

2. The apparatus of claim 1, wherein the plurality of antenna elements are arranged in a common plane.

3. The apparatus of claim 1, wherein the antenna column may be coupled to one or more other antenna columns to form an antenna array.

4. The apparatus of claim 3, wherein:

the antenna column may include the plurality of antenna elements extending in a first plane; and at least one of the one or more other antenna columns may include a plurality of antenna elements extending in a second plane.

5. The apparatus of claim 4, wherein the first plane is orthogonal to the second plane.

6. The apparatus of claim 1, wherein the conductive planar structure and the at least one spacer may be adjusted geometrically to receive radio frequency signals at selected frequencies.

7. The apparatus of claim 1, wherein the plurality of cutout portions forms a symmetric configuration of circuit elements.

8. The apparatus of claim 1, wherein the combiner circuit includes one or more stub shorts configured to provide impedance mismatch cancellation.

9. The apparatus of claim 1, wherein the at least one spacer is formed from a unitary piece of material.

10. A method comprising:

providing a conductive antenna structure having multiple antenna elements, an output interface, and an integrated combiner circuit coupling the multiple antenna elements to the output interface, the multiple antenna elements, the output interface and the integrated combiner circuit formed from a sheet of electrically conductive material; and coupling a spacer to the conductive antenna structure to form an antenna column, the spacer formed from a conductive material and configured to provide a ground plane, the spacer including recesses configured to provide an air gap between the spacer and the integrated combiner circuit.

11. The method of claim 10, further comprising:

providing a second conductive antenna structure having multiple antenna elements, an output interface, and a second integrated combiner circuit coupling the multiple antenna elements to the output interface, the multiple antenna elements, the output interface, and the second integrated combiner circuit of the second conductive antenna formed from a second sheet of electrically conductive material;

coupling a second spacer to the conductive antenna structure to form an second antenna column; and coupling the antenna column to the second antenna column to form an antenna array.

12. The method of claim 11, further comprising:

combining signals from each of the multiple antenna elements of the monolithic, conductive antenna structure using the integrated combiner circuit;

combining signals from each of the multiple antenna elements of the second monolithic, conductive antenna structure using the second integrated combiner circuit; and combining output signals from the integrated combiner circuit and the second integrated combiner circuit using a third combiner circuit.

13. The method of claim 10, wherein before coupling the spacer, the method further comprising removing portions of the spacer to provide an air dielectric around the conductors of the monolithic, conductive antenna structure.

14. The method of claim 10, wherein providing the monolithic, conductive antenna structure comprises:

forming the multiple antenna elements, an output interface, and an integrated combiner circuit from a sheet of conductive material, the integrated combiner circuit formed from a plurality of cutout portions defining strip-line conductors coupling the multiple antenna elements to the output interface.

15. The method of claim 10, wherein the spacer is formed from a unitary piece of material.

16. An apparatus comprising:

an antenna structure formed from sheet of conductive material in a plane, the antenna structure including:

an output interface;

a plurality of antenna elements;

a combiner circuit formed from a plurality of cutout portions defining strip-line conductors extending between the plurality of antenna elements and the output interface; and at least one spacer configured to couple to the conductive planar structure to form an antenna column, the at least one spacer including a plurality of indentations corresponding to the strip-line conductors of the combiner circuit to provide an air gap between the strip-line conductors and the at least one spacer.

17. The apparatus of claim 16, wherein the at least one spacer is formed of a conductive material and is configured to form a ground plane.

18. The apparatus of claim 16, wherein the combiner circuit includes at least one impedance mismatch cancellation stub coupled between one of the strip-line conductors and the at least one spacer.

19. The apparatus of claim 16, wherein the spacer comprises:

a molded plastic substrate; and a conductive coating on surfaces of the molded plastic substrate.

* * * * *